United States Patent [19]

Gilham et al.

[11] Patent Number: 4,917,010

[45] Date of Patent: Apr. 17, 1990

[54] FRANKING MACHINE WITH VARIABLE AND FIXED DATA THERMAL PRINTHEAD

[75] Inventors: Dennis T. Gilham, Ongar; Raymond J. Herbert, Leigh-on-Sea; Cyrus Abumehdi, Harlow, all of United Kingdom

[73] Assignee: Alcatel Business Systems Limited, Romford, United Kingdom

[21] Appl. No.: 297,485

[22] Filed: Jan. 17, 1989

Related U.S. Application Data

[63] Continuation of Ser. No. 100,249, Sep. 23, 1987, abandoned.

[30] Foreign Application Priority Data

Sep. 25, 1986 [GB] United Kingdom ..... 8623061

[51] Int. Cl.[4] ..... B41J 7/76

[52] U.S. Cl. ..... 101/93.04; 101/93.12; 400/120; 346/76 PH; 219/216

[58] Field of Search ..... 400/120, 125; 101/31, 101/21, 287, 93.04, 93.11–93.12; 346/76 PH; 219/216 PH

[56] References Cited

U.S. PATENT DOCUMENTS

| | | | |
|---|---|---|---|
| 87,588 | 3/1869 | Penney | 101/31 |
| 89,829 | 5/1969 | Dodge | 101/31 |
| 2,205,399 | 6/1940 | Edwards | 101/21 |
| 2,486,985 | 11/1949 | Rudeifer | 400/120 |
| 3,453,648 | 7/1969 | Stegenga | 400/125 |
| 3,515,059 | 6/1970 | Sciame | 101/31 |
| 3,973,111 | 8/1976 | Washizuka et al. | 101/31 |
| 3,991,671 | 11/1976 | Aizawa et al. | 101/93.04 |
| 4,455,100 | 6/1984 | Bauer | 101/93.04 |
| 4,518,971 | 5/1985 | Endo | 400/120 |
| 4,519,311 | 5/1985 | Lowe | 101/287 |
| 4,568,950 | 2/1986 | Ross et al. | 101/93.04 |
| 4,580,144 | 4/1986 | Calvi | 400/120 |
| 4,623,901 | 11/1986 | Nagashima | 219/216 PH |
| 4,636,811 | 1/1987 | Bakewell | 219/216 PH |
| 4,739,343 | 4/1988 | Dolan | 400/120 |
| 4,746,234 | 5/1988 | Harry | 400/120 |

FOREIGN PATENT DOCUMENTS

| | | | |
|---|---|---|---|
| 941222 | 7/1982 | U.S.S.R. | 101/31 |

*Primary Examiner*—Eugene H. Eickholt

*Attorney, Agent, or Firm*—Shoemaker and Mattare, Ltd.

[57] ABSTRACT

A franking machine is disclosed which has a thermal printer for printing variable and non-variable information at a single print station. The non-variable information is printed by thermal print elements having a form corresponding to the information pattern and the variable information is printed by arrays of selectable print elements. The elements are preferably heated by passing electric current through the elements. Alternatively, the elements for non-variable information may be heated from a heated substrate.

9 Claims, 3 Drawing Sheets

FRANKING MACHINE WITH VARIABLE AND FIXED DATA THERMAL PRINTHEAD

BACKGROUND TO THE INVENTION

This application is a continuation of now abandoned U.S. Pat. No. 100,249 filed on 9-23-87.

This invention relates to franking machines and in particular to franking machines using a thermal printer for effecting franking of a mail item.

Franking machines are used to print a franking on a mail item such as an envelope to show that the cost of postage has been debited from the account of the user of the machine. This franking normally includes variable information as well as non-variable information. The variable information usually consists of the value of the postage charged on that item and the date of franking the item. It may also include other information such as a check code intended for verifying the validity of the franking. The non-variable information usually includes the country indicia, the name of the town and county from which the mail item is sent and may include the name of the sender of the mail item and an identification number of the franking machine. It is sometimes desired to include advertising material in the non-variable information. The term non-variable information is used to refer to information which either is never changed or is changed infrequently whereas the term variable information refers to information which may change frequently for example for each mail item or each day in the case of the date of franking. In known franking machines using mechanical printing devices the non-variable information is printed by a printing die and the variable information is printed by means of print wheels having print characters on their periphery and which can be rotated to bring selected ones of the characters into printing position. The print wheels extend into an aperture in the printing die. The printing die may be flat and co-operate with a reciprocating platen or the die may be curved and be mounted on a rotatable drum. In constructions of franking machine utilising a rotatable drum, a franking impression is effected on an envelope or other mail item, by inking the printing die and the selected print characters positioned in the aperture of the die and then rotating the drum to make rolling contact with the envelope. Thus the variable and non-variable information are printed simultaneously. Such printing devices and particularly the mechanisms for ensuring correct setting of the print wheels are relatively complicated and costly to manufacture. In addition it is desirable to use electronic circuitry in the franking machine to carry out the accounting and control functions and hence when mechanical printing devices are used it is necessary to provide interfaces between the mechanical and electronic components of the machine.

It has been proposed to use electronically operated printers which function by a thermal transfer process in franking machines. Such printers comprise a plurality of print elements consisting of electrically resistive material which can be electronically selected and the selected elements heated by the passage of electric current therethrough. A mail item such as a label or envelope is fed past the print elements with an ink transfer ribbon interposed between the mail item and the print elements whereby areas of the ink transfer ribbon in the vicinity of the energised elements are heated and thereby cause the ink in those areas to be transferred to the surface of the mail item. The print elements are arranged in a single line extending perpendicular to the direction of feed of the envelope and a complete franking impression is produced by repeated selection and energisation of the print elements in synchronism with the feeding of the mail item. Such thermal transfer printers have the advantage that they are less complicated than the previously used mechanical printers and do not require electro-mechanical interfaces to the electronic accounting and control circuitry. However, since the printing is effected line by line, the time taken to form a complete franking impression is unacceptably long particularly when it is desired to print information additional to the basic franking information.

In an attempt to reduce the time required to print a complete franking impression which contains additional information such as an advertising slogan it has been proposed to provide two separate printing stations. One of these stations comprises an etched screen carried by a drum with a radiant heat source inside the drum. The other station comprises a thermal printer arranged to print the variable information. A postage tape together with an ink transfer ribbon is fed adjacent the periphery of the drum, the ribbon being interposed between the tape and the drum, whereby heat from the heat source is enabled to pass through the etched screen to the ink transfer ribbon. The etching is in the form of a pattern desired to be printed on the tape and ink corresponding to this pattern is transferred to the tape. After passing adjacent the drum, the tape together with the ribbon is fed past the thermal printer of the other printing station where the variable information is printed onto the tape. While this arrangement of two separate printing stations may allow the time taken for printing to be reduced it has the disadvantage that, in order to ensure that the two separately formed portions of the franking impression are correctly aligned relative to one another, it is essential to ensure that the mechanical feed of the tape past both printing stations is in accurate registration and that the timing of the electrical operation of the printer for variable information is accurately related to the feeding of the tape from the other printing station. Furthermore while such an arrangement may be satisfactory for printing franking impressions on a postage tape which is readily flexible, it is considered that satisfactory feeding of mail items consisting of envelopes, which are relatively stiff, would not be attained with the consequence of misalignment of the portions of the franking impression.

SUMMARY OF THE INVENTION

According to the invention a franking machine includes a thermal printing head for printing variable and non-variable information at a single printing station including a first plurality of printing elements defining the non-variable information to be printed and a second plurality of printing elements individually selectable to print the variable information; means to feed a mail item to the printing station; and means to heat the first plurality of printing elements and selected printing elements of the printing elements of the second plurality to effect printing of the non-variable and the variable information at said printing station.

BRIEF DESCRIPTION OF THE DRAWINGS

An embodiment of the invention will now be described with reference by way of example to the drawings in which.

DESCRIPTION OF THE PREFERRED EMBODIMENT

Figure 1:
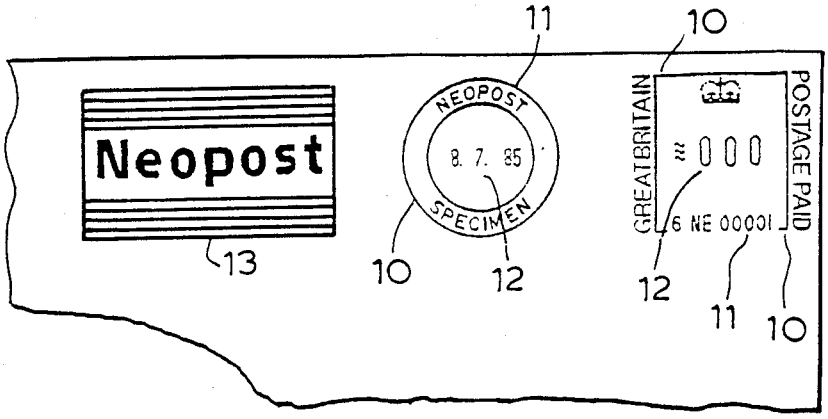
FIG. 1 shows a typical franking impression together with an advertising slogan on a mail item

The form of impression on an envelope effective to frank the envelope is determined by the postal authority for the particular country in which the mail item is posted. FIG. 1 shows the form of franking impression which is at present required in the United Kingdom. It consists of parts 10 which are non-variable and are applied to every mail item, other parts 11 which are specific to a particular user and further parts 12 which are variable from day to day and for each mail item. The parts 11, for example, contain the users name, the location of the post office receiving the mail item and the licence number of the franking machine. The parts 12, which are variable, consist of the value of the postage paid and the date of the franking. In addition it is common, at the time of franking a mail item, to print an advertising slogan 13 on the mail item. This slogan may be printed only for a limited period and it may be desired to change it periodically.

Figure 2:
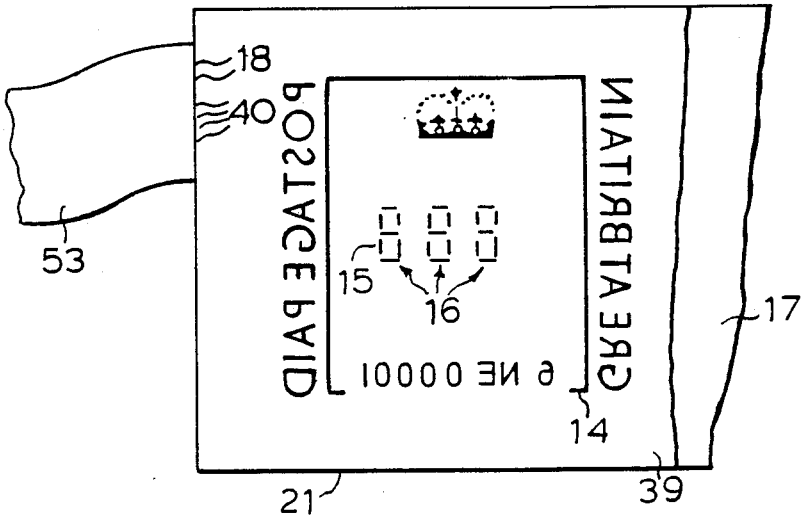
FIG. 2 shows a part of a printing head for printing part of the franking shown in FIG. 1
Figure 4:
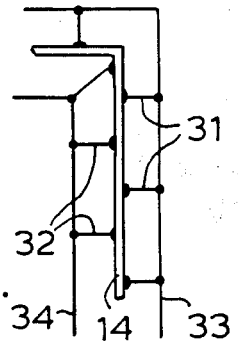
FIG. 4 shows the arrangement of electrical connections to thermal printing printing elements
Figure 5:
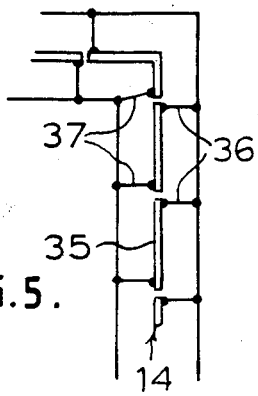
FIG. 5 shows an alternative construction of thermal printing elements
Figure 6:
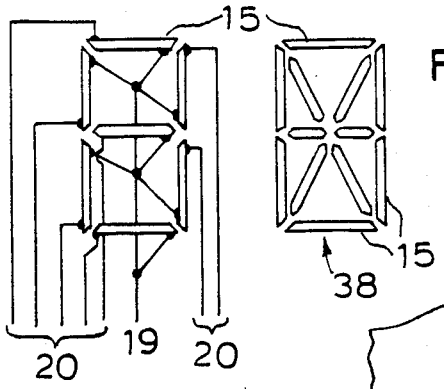
FIG. 6 shows arrays of thermal printing elements for printing numeric characters and for printing both alpha and numeric characters

Referring now to FIG. 2, a part of a thermal printing head is shown for printing the right hand portion of the franking impression shown in FIG. 1. The head includes a plurality of thermal elements mounted on a substrate and these elements can be heated by the passage of electric current through the elements. One set of thermal elements 14 define those parts 10 which are non-variable. These elements consist of strips of electrically resistive material extending in a plane at an operative face of the printing head. Each individual character or line may be formed as a continuous strip, as shown in FIG. 4, having electrical connections 31, 32 alternately at positions spaced along the length of the strip so as to divide the strips electrically into elements having similar electrical resistance. The connections 31 are connected to a common conductor 33 and the connections 32 are connected to a common conductor 34 for connection to a current supply. Alternatively, as shown in FIG. 5, each character or line may be formed of physically separate elements 35 each having connections 36, 37 for the supply of electrical current to energise the element. A second set of elements 15 are selectable for electrical energisation and are arranged in arrays 16. These arrays 16 are each intended for printing one of the digits of a postal charge value. Similar arrays are provided for printing other variable parts of the franking impression such as the date on which franking is effected. The arrays 16 each have seven elements so arranged that by appropriate selection of the elements 15 of an array 16, any digit between 0 and 9 can be printed. As shown in FIG. 6 electrical connections 19, 20 respectively are provided to the ends of each element 15 to enable electrical current to be passed therethrough in order to heat the element. Parts 11 of the impression specific to a particular user may be printed by providing elements 14 of the required form or may be printed by providing further arrays of elements 15. Some parts 11 may require the printing of alphabetic as well as numeric characters. Accordingly, at least in those positions where alphabetic characters are required to be printed by an array of elements, the arrays have additional elements to form, for example, 12 element arrays capable of printing both alphabetic and numeric characters as shown by the array 38 in FIG. 6.

The printing elements 14, 15 are carried on a substrate 17 and are electrically insulated from it by a layer of insulation 39. Electrical connections 40 to the printing elements 14,15, formed by printed circuit techniques, extend from an edge of the printing head within the thickness of the insulation layer to the resistive strips forming the printing elements. Connections to the elements 14 may be connected together within the head to common external connectors 18 or may be provided with separate external connections to the edge of the substrate. The elements 15 of each of the arrays 16 may have a connection 19 common to that array and a separate connection 20 to each element. The connections at the edge of the substrate preferably extend away from the substrate as a flexible printed circuit ribbon cable 53 for connection to selection and control circuitry.

Figure 3:
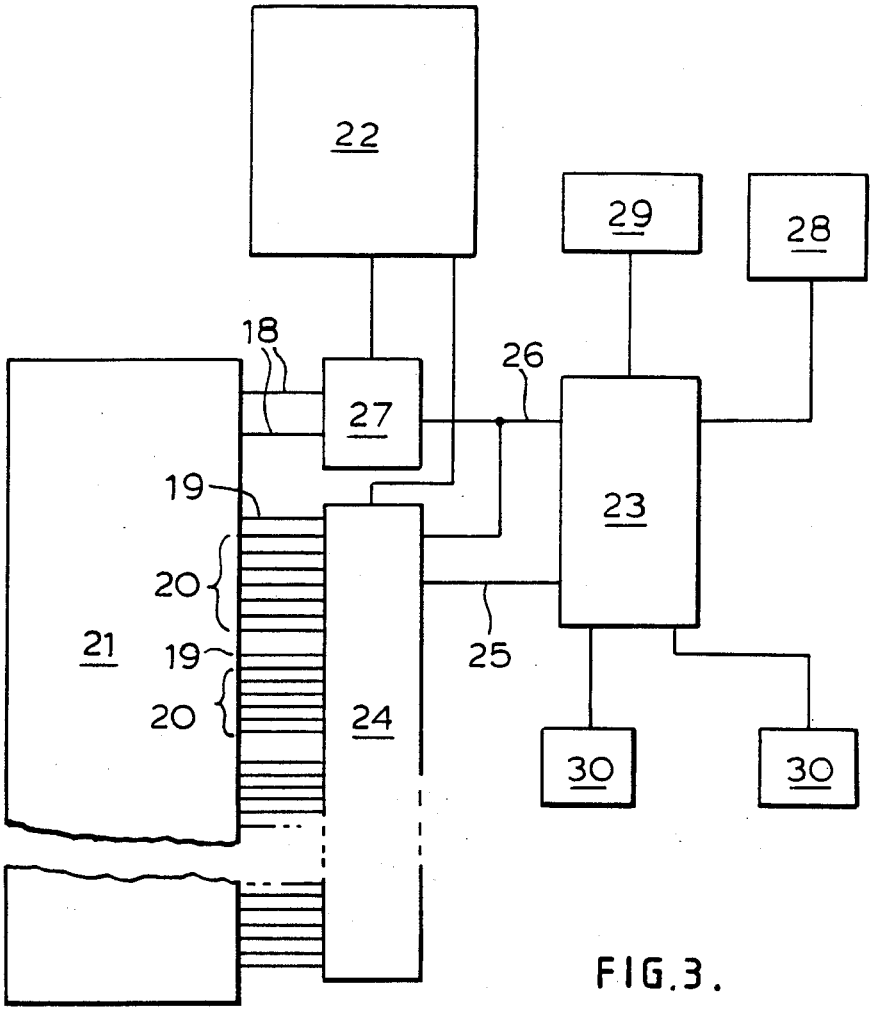
FIG. 3 is a block diagram of an electronic circuit for carrying out accounting functions and for controlling operation of the printing head

FIG. 3 illustrates an electronic circuit for providing accounting functions for the franking machine and for providing selection and control of operation of the printing elements of the printing head. The printing elements of the printing head 21 are energised by electric current from a power supply 22 and the energisation is controlled by a microprocessor 23. The microprocessor 23 is utilised in the franking machine for carrying out accounting functions and control functions as well as controlling the operation of the print head 21. A keyboard 28 is provided to enable a user to input data such as the value of franking required to the microprocessor 23. A display 29 controlled by the microprocessor is provided to enable display to a user of data input on the keyboard and of status data relating to the operation of the franking machine. Memories 30 are provided for the storage of accounting data. As is well known in the franking machine art, the memories preferably include descending registers for registering the value of credit available for use in franking, ascending registers for registering an accumulated value of franking used and registers for registering a count of the number of items franked by the machine. Energisation of the elements 15 of the arrays 16 is determined by a selection circuit 24 controlled by print data signals from the microprocessor on line 25. The selection circuit may consist of a register having stages corresponding to the print elements 15 to be selected and gates controlled by the contents of the register stages for feeding current to the selected elements. Print data signals on line 25 set the stages of the register to cause those elements 15 of the arrays which are required to be energised to effect printing of the required data to be selected by the selection circuit 24. When printing is required to take place, the microprocessor 23 outputs a strobe signal on line 26 which enables the gates of the selection circuit 24 to energise the selected elements from the current power supply 22. The elements 14 for printing non-variable parts of the franking impression are connected to the power supply 22 through a switch 27 which is operated by the strobe signal on line 26. It will be understood from the description hereinbefore that the printing elements for printing non-variable information 10 are permanently connected for energisation whereas printing elements for printing variable information 12 are electronically selected for each printing operation. If the information 11 relating to a particular user is printed by elements formed to define that information these elements are permanently connected for energisation in the same way as the elements 14 for printing the non-variable information. However, if the elements for printing the information 11 are provided as selectable elements in arrays they may be connected to be electronically selectable in the same manner as the elements 15 for printing variable information. Alternatively the selection of the elements may be predetermined by providing appropriate wiring connections to only those elements required to be operated to print the information 11.

The elements may all be energised simultaneously or if this imposes too great a load on the power supply, they may be connected in groups which are energised in succession to print the entire franking impression.

Figure 7:
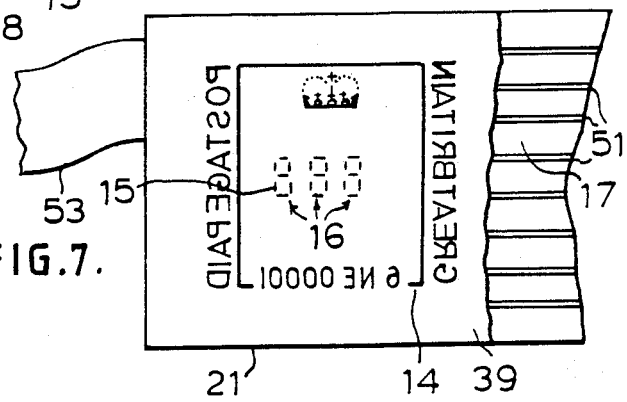
FIGS. 7 and 8 show alternative methods of heating a substrate of a thermal printing head
Figure 8:
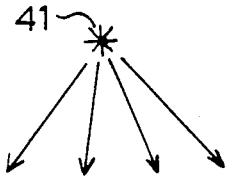

If desired, instead of heating the printing elements 14 by the passage of electric current therethrough, they may be arranged in heat transfer relationship with the substrate on which they are carried and the heating of the elements may be effected by applying heat to the substrate. Heating of the substrate may be effected by an electrically resistive heating element 51 secured in heat transfer relationship to the substrate as shown in FIG. 7. Alternatively the substrate may be heated by means of radiation from a source 41 as shown in FIG. 8. Due to the heat capacity of the substrate this would require the printing elements 14 to be held withdrawn from the ink transfer ribbon and only brought into contact when printing is to be effected. In addition, the selectable printing elements 15 of the arrays 16 would be thermally isolated from the heated substrate.

Figure 9:
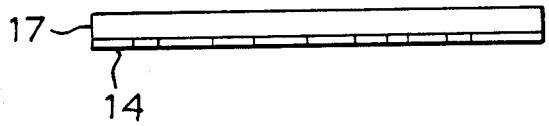
FIG. 9 shows the mechanical arrangement of a thermal printer.
Figure 9:
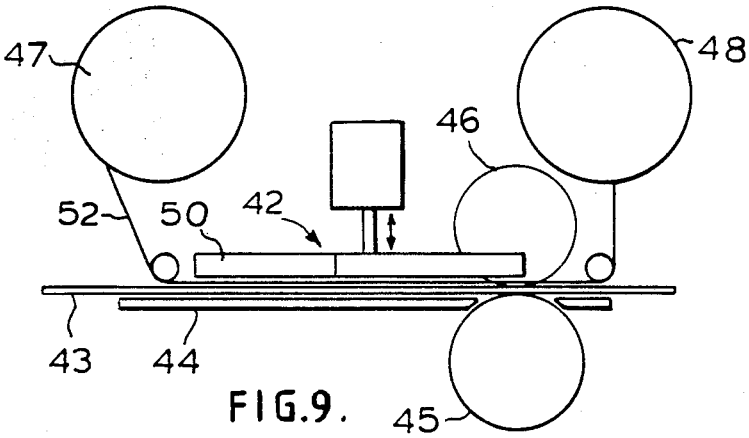

FIG. 9 shows the general arrangement of a thermal printer utilising a thermal print head 42. Mail items 43 are fed along a feed bed 44 by one or more driven feed rollers 45 and co-operating pressure rollers 46 adjacent the print elements of the head 42. A thermal transfer ribbon 52 is fed from a spool 47 between the print head and the mail item to a take up spool 48, the ribbon being fed at the same speed as that of the mail item during passage of the mail item past the printing head. For constructions of print head in which all the print elements are heated by passage of electric current therethrough, the print head is maintained adjacent the feed bed. However if the print elements for printing nonvariable information are heated by heating of the print head substrate and the print head is required to be retracted from the printing position adjacent the feed bed, means 49 is provided and is operated between each printing of a franking impression to move the print head away from its printing position.

It is to be understood that the form of franking impression illustrated in FIG. 1 is shown as an example. Other forms of franking impression may be employed where this is acceptable to or required by the postal authority concerned. When it is desired to print an advertising slogan 13 a removable printing head 50, see FIG. 9, may be provided secured to the printing head for printing the franking impression. This removable head is preferably formed with printing elements defining the required pattern to be printed in the same manner as the elements for printing the non-variable portions of the franking impression.

If desired instead of the printing elements in the arrays being elongate strips, these arrays may consist of a matrix of dot printing elements individually selectable to print a desired character or other pattern. It will be appreciated that the provision of arrays of elements either in the form of strips or dots for printing characters provides a speed advantage over a thermal printer using a single thermal strip for selectively printing a row of dots and which requires sequential operation to build up the characters. Furthermore, if desired, the printing elements for printing the non-variable information may be in the form of dot printing elements.

We claim:

1. A franking machine including a thermal printing device for printing variable and non-variable information at a single printing station said machine including a substrate; a group of first printing elements mounted on said substrate; a plurality of second printing elements mounted on said substrate; electronic control and accounting means operable in a franking printing operation to output print selection signals and a print control signal; a supply of electrical power; a switch responsive to said control signal; first means connecting said supply of electrical power to all said first printing elements in said group through said switch to pass electrical current from said supply through all said first printing elements of said group of printing elements to effect heating of all said first printing elements of said group; print element selection means; second means connecting said supply of electrical power to said print element selection means; said print element selection means being operative in response to said print selection signals to select second print elements which are to be energised and heated by electrical power from said supply and operable in response to said print control signal to pass electrical current through said selected second printing elements to heat said selected second printing elements; means to feed a mail item to the printing station with a print receiving surface of the mail item opposed to said first and second printing elements; ribbon feed means to position a length of thermal transfer inked ribbon between said mail item and said first and second printing elements; all of said first and second printing elements being in engagement with a rear surface of said ribbon and said print receiving surface of said mail item being in engagement with a front ink bearing surface of the ribbon; said heating of all said first printing elements of said group and of said selected second elements being effective to transfer ink from the front surface of the ribbon directly to the print receiving surface of the mail item to print a composite print impression including said non-variable information and said variable at said single print station.

2. A franking machine as claimed in claim 1 in which the second printing elements are interposed between printing elements of the group of first printing elements.

3. A franking machine as claimed in claim 1 in which at least some of the second printing elements are arranged in a plurality of arrays, elements in each array corresponding to segments of desired characters to be printed.

4. A franking machine as claimed in claim 1 wherein said first elements comprise resistive strips having a form of a desired pattern of non-variable information to be printed and wherein first and second electrical connections to said strips are provided alternately along the length of said strips for the passage of electric current from the power supply through the strips.

5. A franking machine including a thermal printing device for printing variable and non-variable information at a single printing station, said printing device including:

a stationary substrate carrying a plurality of first printing elements and a plurality of second printing elements, said elements being in fixed relationship to one another;

said first printing elements comprising electrically resistive strips defining a pattern corresponding to non-variable information to be printed;

said second printing elements each comprising an electrically resistive strip;

print element selection means operable to route electrical current through selected ones of said second printing elements;

switch means operable to apply electrical current to all said first printing elements;

a thermal transfer ribbon extending across and in engagement with the first and second printing elements, said ribbon including a layer of ink on a surface thereof remote from the printing elements;

means to feed a mail item to a printing position in which a print receiving surface of the mail item is opposed to said first and second printing elements and lies in engagement with said ink layer of the ribbon;

print control means operable to operate the print selection means to route electrical current through selected ones of said second printing elements to heat only said selected second elements to effect transfer of ink from said ribbon directly to said print receiving surface of the mail item thereby to print variable information on the mail item at said printing position and to operate the switch means to apply electrical current to all said first printing elements to heat all of said first printing elements to effect transfer of ink from said ribbon directly to said print receiving surface of the mail item thereby to print non-variable information on the mail item at said printing position.

6. A franking machine as claimed in claim 5 including means to input a value of franking;

said print control means being operative in response to the input of a value of franking to operate said print selection means to select those ones of said second printing elements required to print said value.

7. A franking machine as claimed in claim 5 wherein said first printing elements define non-variable portions of a franking impression to be printed on a mail item and wherein said second printing elements are arranged in at least one array, selection of second printing elements in said array being effective to print a selected one of a plurality of numeric characters printable by the elements of the array representing a variable value of postage charge.

8. A franking machine as claimed in claim 5 wherein said print control means outputs print element selection signals to condition the print element selection means to select ones of said second printing elements through which current is to be routed and said print control means outputs a print control signal to operate the print element selection means to pass current through the selected second elements and to operate the switch means to pass current through all the first printing elements.

9. A franking machine as claimed in claim 5 wherein at least one of said first printing elements is provided with a plurality of first electrical connections and a plurality of second electrical connections, said connections being spaced apart along the length of said element with the first electrical connections alternating with the second electrical connections; electrical current being directed to said first connections for flow through the first printing element to the second electrical connections.

* * * * *